US010027016B2

(12) United States Patent
Marion et al.

(10) Patent No.: US 10,027,016 B2
(45) Date of Patent: Jul. 17, 2018

(54) ANTENNA FOR AN AEROSOL DELIVERY DEVICE

(71) Applicant: R. J. REYNOLDS TOBACCO COMPANY, Winston-Salem, NC (US)

(72) Inventors: Nathan T. Marion, Raleigh, NC (US); Rodney O. Williams, Cary, NC (US); Charles E. Greene, Cary, NC (US); Wilson Christopher Lamb, Hillsborough, NC (US); Raymond Charles Henry, Jr., Cary, NC (US); Frederic Philippe Ampolini, Winston-Salem, NC (US)

(73) Assignee: RAI STRATEGIC HOLDINGS INC., Winston-Salem, NC (US)

( * ) Notice: Subject to any disclaimer, the term of this patent is extended or adjusted under 35 U.S.C. 154(b) by 83 days.

(21) Appl. No.: 14/802,789

(22) Filed: Jul. 17, 2015

(65) Prior Publication Data

US 2016/0261021 A1 Sep. 8, 2016

Related U.S. Application Data

(63) Continuation-in-part of application No. 14/638,562, filed on Mar. 4, 2015.

(51) Int. Cl.

| | |
|---|---|
| ***H01Q 1/22*** | (2006.01) |
| ***A24F 47/00*** | (2006.01) |
| ***H01Q 9/16*** | (2006.01) |

(52) U.S. Cl.

CPC ..... *H01Q 1/22* (2013.01); *A24F 47/008* (2013.01); *H01Q 9/16* (2013.01)

(58) Field of Classification Search

CPC ... H01Q 1/44; H01Q 9/16; H01Q 1/22; A24F 47/008

USPC ..... 343/720

See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 3,200,819 | A | 8/1965 | Gilbert |
| 4,284,089 | A | 8/1981 | Ray |
| 4,303,083 | A | 12/1981 | Burruss, Jr. |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Jessica Han
*Assistant Examiner* — Jae Kim
(74) *Attorney, Agent, or Firm* — Womble Bond Dickinson (US) LLP

(57) ABSTRACT

An aerosol delivery device is provided that includes at least one housing, and a control component and communication interface contained within the housing. The control component is configured to control operation of at least one functional element of the aerosol delivery device based on a detected flow of air through at least a portion of the housing. The communication interface coupled to the control component and configured to enable wireless communication. The communication interface including an antenna, and the housing and antenna are being electrically resonant and tightly coupled in a manner that forms dipole antenna.

22 Claims, 8 Drawing Sheets

(56) References Cited

U.S. PATENT DOCUMENTS 4,735,217 A 4/1988 Gerth et al.
4,848,374 A 7/1989 Chard et al.
4,907,606 A 3/1990 Lilja et al.
4,922,901 A 5/1990 Brooks et al.
4,945,931 A 8/1990 Gori
4,947,874 A 8/1990 Brooks et al.
4,947,875 A 8/1990 Brooks et al.
4,986,286 A 1/1991 Roberts et al.
5,019,122 A 5/1991 Clearman et al.
5,042,510 A 8/1991 Curtiss et al.
5,060,671 A 10/1991 Counts et al.
5,093,894 A 3/1992 Deevi et al.
5,144,962 A 8/1992 Counts et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,369,379 A 11/1994 Fujiki
5,369,723 A 11/1994 Counts et al.
5,372,148 A 12/1994 McCafferty et al.
5,388,574 A 2/1995 Ingebrethsen et al.
5,408,574 A 4/1995 Deevi et al.
5,468,936 A 11/1995 Deevi et al.
5,498,850 A 3/1996 Das
5,515,842 A 5/1996 Ramseyer et al.
5,530,225 A 6/1996 Hajaligol
5,564,442 A 10/1996 MacDonald et al.
5,649,554 A 7/1997 Sprinkel et al.
5,666,977 A 9/1997 Higgins et al.
5,687,746 A 11/1997 Rose et al.
5,726,421 A 3/1998 Fleischhauer et al.
5,727,571 A 3/1998 Meiring et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,934,289 A 8/1999 Watkins et al.
5,954,979 A 9/1999 Counts et al.
5,967,148 A 10/1999 Harris et al.
6,011,519 A 1/2000 Sadler et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,854,461 B2 2/2005 Nichols
6,854,470 B1 2/2005 Pu
7,117,867 B2 10/2006 Cox et al.
7,293,565 B2 11/2007 Griffin et al.
7,513,253 B2 4/2009 Kobayashi et al.
7,545,328 B2 * 6/2009 Son ..... H01Q 1/22 343/700 MS
7,775,459 B2 8/2010 Martens, III et al.
7,832,410 B2 11/2010 Hon
7,845,359 B2 12/2010 Montaser
7,896,006 B2 3/2011 Hamano et al.
8,127,772 B2 3/2012 Montaser
8,314,591 B2 11/2012 Terry et al.
8,365,742 B2 2/2013 Hon
8,402,976 B2 3/2013 Fernando et al.
8,499,766 B1 8/2013 Newton
8,528,569 B1 9/2013 Newton
8,550,069 B2 10/2013 Alelov
2002/0146242 A1 10/2002 Vieira
2003/0226837 A1 12/2003 Blake et al.
2004/0118401 A1 6/2004 Smith et al.
2004/0129280 A1 7/2004 Woodson et al.
2004/0200488 A1 10/2004 Felter et al.
2004/0226568 A1 11/2004 Takeuchi et al.
2005/0016550 A1 1/2005 Katase
2006/0016453 A1 1/2006 Kim
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2008/0085103 A1 4/2008 Beland et al.
2008/0092912 A1 * 4/2008 Robinson ..... A24F 47/008 131/200
2008/0257367 A1 10/2008 Paterno et al.
2008/0276947 A1 11/2008 Martzel
2008/0302374 A1 12/2008 Wengert et al.
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0272379 A1 11/2009 Thorens et al.
2009/0283103 A1 11/2009 Nielsen et al.
2009/0320863 A1 12/2009 Fernando et al.
2010/0043809 A1 2/2010 Magnon
2010/0083959 A1 4/2010 Siller
2010/0200006 A1 8/2010 Robinson et al.
2010/0229881 A1 9/2010 Hearn
2010/0242974 A1 9/2010 Pan
2010/0245186 A1 * 9/2010 Kojima ..... H01Q 1/243 343/702
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0094523 A1 4/2011 Thorens et al.
2011/0126848 A1 6/2011 Zuber et al.
2011/0155153 A1 6/2011 Thorens et al.
2011/0155718 A1 6/2011 Greim et al.
2011/0168194 A1 7/2011 Hon
2011/0265806 A1 11/2011 Alarcon et al.
2011/0309157 A1 12/2011 Yang et al.
2012/0042885 A1 2/2012 Stone et al.
2012/0060853 A1 3/2012 Robinson et al.
2012/0111347 A1 5/2012 Hon
2012/0132643 A1 5/2012 Choi et al.
2012/0227752 A1 9/2012 Alelov
2012/0231464 A1 9/2012 Yu et al.
2012/0260927 A1 10/2012 Liu
2012/0279512 A1 11/2012 Hon
2012/0318882 A1 12/2012 Abehasera
2013/0037041 A1 2/2013 Worm et al.
2013/0056013 A1 3/2013 Terry et al.
2013/0081625 A1 4/2013 Rustad et al.
2013/0081642 A1 4/2013 Safari
2013/0192619 A1 8/2013 Tucker et al.
2013/0249751 A1 * 9/2013 Legare ..... H01Q 21/0006 343/745
2013/0306084 A1 11/2013 Flick
2013/0319439 A1 12/2013 Gorelick et al.
2013/0340750 A1 12/2013 Thorens et al.
2013/0340775 A1 * 12/2013 Juster ..... H04L 67/42 131/273
2014/0060554 A1 3/2014 Collett et al.
2014/0060555 A1 3/2014 Chang et al.
2014/0096781 A1 4/2014 Sears et al.
2014/0096782 A1 * 4/2014 Ampolini ..... A24F 47/008 131/328
2014/0261400 A1 * 9/2014 Addington ..... A61M 11/06 128/200.21
2014/0270727 A1 * 9/2014 Ampolini ..... A24F 47/008 392/387

(56) References Cited

U.S. PATENT DOCUMENTS

| | | | | |
|---|---|---|---|---|
| 2014/0338685 | A1* | 11/2014 | Amir | A24F 47/008 131/329 |
| 2015/0136158 | A1* | 5/2015 | Stevens | A24F 47/008 131/329 |
| 2015/0333561 | A1* | 11/2015 | Alarcon | H02J 7/0042 131/329 |

FOREIGN PATENT DOCUMENTS

| | | | |
|---|---|---|---|
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 201379072 | | 1/2010 |
| DE | 10 2006 004 484 | | 8/2007 |
| DE | 102006041042 | | 3/2008 |
| DE | 20 2009 010 400 | | 11/2009 |
| EP | 0 295 122 | | 12/1988 |
| EP | 0 430 566 | | 6/1991 |
| EP | 0 845 220 | | 6/1998 |
| EP | 1 618 803 | | 1/2006 |
| EP | 2 316 286 | | 5/2011 |
| GB | 2469850 | | 11/2010 |
| JP | 2011239347 | A * | 11/2011 |
| WO | WO 1997/48293 | | 12/1997 |
| WO | WO 2004/043175 | | 5/2004 |
| WO | WO 2004/080216 | | 9/2004 |
| WO | WO 2005/099494 | | 10/2005 |
| WO | WO 2007/078273 | | 7/2007 |
| WO | WO 2007/131449 | | 11/2007 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/118644 | | 10/2010 |
| WO | WO 2010/140937 | | 12/2010 |
| WO | WO 2011/010334 | | 1/2011 |
| WO | WO 2012/072762 | | 6/2012 |
| WO | WO 2012/100523 | | 8/2012 |
| WO | WO 2013/089551 | | 6/2013 |
| WO | 2014011943 | A1 | 1/2014 |
| WO | 20140182392 | A1 | 11/2014 |

* cited by examiner

ANTENNA FOR AN AEROSOL DELIVERY DEVICE

CROSS-REFERENCE TO RELATED APPLICATION(S)

The present application is a continuation-in-part of U.S. patent application Ser. No. 14/638,562, entitled: An Antenna for an Aerosol Delivery Device, filed on Mar. 4, 2015, the content of which is incorporated herein by reference in its entirety.

TECHNOLOGICAL FIELD

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from, or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar or pipe smoking, but without delivering considerable quantities of incomplete combustion and pyrolysis products that result from the burning of tobacco. To this end, there have been proposed numerous smoking products, flavor generators and medicinal inhalers that utilize electrical energy to vaporize or heat a volatile material, or attempt to provide the sensations of cigarette, cigar or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. App. Pub. No. 2013/0255702 to Griffith Jr. et al., and U.S. Pat. App. Pub. No. 2014/0096781 to Sears et al., all of which are incorporated herein by reference in their entireties. See also, for example, the various types of smoking articles, aerosol delivery devices and electrically-powered heat generating sources referenced by brand name and commercial source in U.S. patent application Ser. No. 14/170,838 to Bless et al., filed Feb. 3, 2014, which is incorporated herein by reference in its entirety. Additionally, other types of smoking articles have been proposed in U.S. Pat. No. 5,505,214 to Collins et al., U.S. Pat. No. 5,894,841 to Voges, U.S. Pat. No. 6,772,756 to Shayan, U.S. Pat. App. Pub. No. 2006/0196518 to Hon, and U.S. Pat. App. Pub. No. 2007/0267031 to Hon, all of which are incorporated herein by reference in their entireties. One example of a popular type of so-called e-cigarette has been commercially available under the trade name VUSE™ by RJ Reynolds Vapor Company.

It would be desirable to provide a smoking article that employs heat produced by electrical energy to provide the sensations of cigarette, cigar, or pipe smoking, that does so without combusting or pyrolyzing tobacco to any significant degree, that does so without the need of a combustion heat source, and that does so without necessarily delivering considerable quantities of incomplete combustion and pyrolysis products. Further, advances with respect to manufacturing electronic smoking articles would be desirable.

BRIEF SUMMARY

The present disclosure relates to aerosol delivery devices, methods of forming such devices, and elements of such devices. According to one aspect of example implementations of the present disclosure, an aerosol delivery device is provided. The aerosol delivery device includes at least one housing, and a control component and communication interface contained within the housing. The control component is configured to control operation of at least one functional element of the aerosol delivery device based on a detected flow of air through at least a portion of the housing. The communication interface is coupled to the control component and configured to enable wireless communication. The communication interface including an antenna (e.g., monopole antenna), and the housing and antenna are both electrically resonant and tightly coupled in a manner that forms dipole antenna.

In some examples, the housing is formed of a metal or alloy, and is substantially tubular in shape.

In some examples, the aerosol delivery device includes a control body with the housing, control component and communication interface. In these examples, the aerosol delivery device further includes a cartridge integral with or coupleable to the control body. The cartridge includes a heating element configured to activate and vaporize components of an aerosol precursor composition under control of the control component in response to the flow of air through at least a portion of the housing of the control body, with the air being combinable with a thereby formed vapor to form an aerosol.

In some further examples, the control body and cartridge, when coupled, have a combined length that is approximately a full wavelength within a desired frequency band for wireless communication. And in yet some further examples, the combined length may be approximately a full wavelength at the center of the desired frequency band.

In some examples, the antenna is a chip antenna mounted to a printed circuit board of the control component.

In some examples, the antenna is a half-wave or quarter-wave antenna.

In some examples, the antenna is a wire antenna extending along a longitudinal length of the housing between opposing longitudinal ends thereof.

In some examples, the antenna is a flexible circuit antenna extending along a longitudinal length of the housing between opposing longitudinal ends thereof. In some further examples, the flexible circuit antenna comprises a substrate having a stripline feed and an antenna element affixed thereto. In these further examples, the stripline feed may be coupled to the control component and antenna element at opposing longitudinal ends of thereof.

In some examples, the antenna is a meander-line antenna implemented as a conductive trace on a printed circuit board of the control component.

In another aspect of example implementations, a method is provided for assembling an aerosol delivery device. The features, functions and advantages discussed herein may be achieved independently in various example implementations or may be combined in yet other example implementations further details of which may be seen with reference to the following description and drawings.

BRIEF DESCRIPTION OF THE DRAWING(S)

Having thus described the disclosure in the foregoing general terms, reference will now be made to the accompanying drawings, which are not necessarily drawn to scale, and wherein:

DETAILED DESCRIPTION

Figure 1:
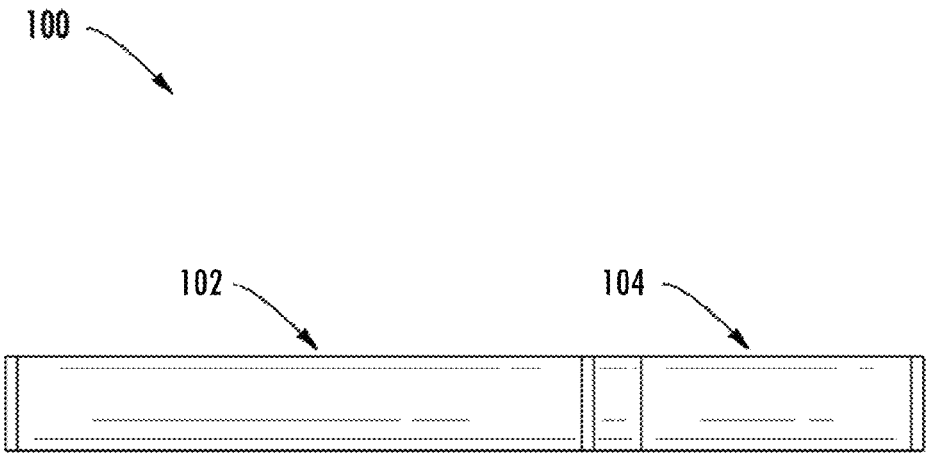
FIG. 1 illustrates a side view of an aerosol delivery device including a cartridge coupled to a control body according to an example implementation of the present disclosure.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise.

As described hereinafter, example implementations of the present disclosure relate to aerosol delivery systems. Aerosol delivery systems according to the present disclosure use electrical energy to heat a material (preferably without combusting the material to any significant degree) to form an inhalable substance; and components of such systems have the form of articles most preferably are sufficiently compact to be considered hand-held devices. That is, use of components of preferred aerosol delivery systems does not result in the production of smoke in the sense that aerosol results principally from by-products of combustion or pyrolysis of tobacco, but rather, use of those preferred systems results in the production of vapors resulting from volatilization or vaporization of certain components incorporated therein. In some example implementations, components of aerosol delivery systems may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

Aerosol delivery systems of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

Aerosol delivery systems of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In one example, all of the components of the aerosol delivery device are contained within one housing. Alternatively, an aerosol delivery device can comprise two or more housings that are joined and are separable. For example, an aerosol delivery device can possess at one end a control body comprising a housing containing one or more reusable components (e.g., a rechargeable battery and various electronics for controlling the operation of that article), and at the other end and integral with or removably coupleable thereto, an outer body or shell containing a disposable portion (e.g., a disposable flavor-containing cartridge).

Aerosol delivery systems of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microprocessor, individually or as part of a microcontroller), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in background art section of the present disclosure.

In various examples, an aerosol delivery device can comprise a reservoir configured to retain the aerosol precursor composition. The reservoir particularly can be formed of a porous material (e.g., a fibrous material) and thus may be referred to as a porous substrate (e.g., a fibrous substrate).

A fibrous substrate useful as a reservoir in an aerosol delivery device can be a woven or nonwoven material formed of a plurality of fibers or filaments and can be formed of one or both of natural fibers and synthetic fibers. For example, a fibrous substrate may comprise a fiberglass material. In particular examples, a cellulose acetate material can be used. In other example implementations, a carbon material can be used. A reservoir may be substantially in the form of a container and may include a fibrous material included therein.

FIG. 1 illustrates a side view of an aerosol delivery device 100 including a control body 102 and a cartridge 104, according to various example implementations of the present disclosure. In particular, FIG. 1 illustrates the control body and the cartridge coupled to one another. The control body and the cartridge may be permanently or detachably aligned in a functioning relationship. Various mechanisms may connect the cartridge to the control body to result in a threaded engagement, a press-fit engagement, an interference fit, a magnetic engagement or the like. The aerosol delivery device may be substantially rod-like, substantially tubular shaped, or substantially cylindrically shaped in some example implementations when the cartridge and the control body are in an assembled configuration. The cartridge and control body may include a unitary housing or outer body or separate, respective housings or outer bodies, which may be formed of any of a number of different materials. The housing may be formed of any suitable, structurally-sound material. In some examples, the housing may be formed of a metal or alloy, such as stainless steel, aluminum or the like. Other suitable materials include various plastics (e.g., polycarbonate), metal-plating over plastic and the like.

In some example implementations, one or both of the control body 102 or the cartridge 104 of the aerosol delivery device 100 may be referred to as being disposable or as being reusable. For example, the control body may have a replaceable battery or a rechargeable battery and thus may be combined with any type of recharging technology, including connection to a typical alternating current electrical outlet, connection to a car charger (i.e., a cigarette lighter receptacle), and connection to a computer, such as through a universal serial bus (USB) cable or connector. Further, in some example implementations, the cartridge may comprise a single-use cartridge, as disclosed in U.S. Pat. No. 8,910,639 to Chang et al., which is incorporated herein by reference in its entirety.

In one example implementation, the control body 102 and cartridge 104 forming the aerosol delivery device 100 may be permanently coupled to one another. Examples of aerosol delivery devices that may be configured to be disposable and/or which may include first and second outer bodies that are configured for permanent coupling are disclosed in U.S. patent application Ser. No. 14/170,838 to Bless et al., filed Feb. 3, 2014, which is incorporated herein by reference in its entirety. In another example implementation, the cartridge and control body may be configured in a single-piece, non-detachable form and may incorporate the components, aspects, and features disclosed herein. However, in another example implementation, the control body and cartridge may be configured to be separable such that, for example, the cartridge may be refilled or replaced.

Figure 2:
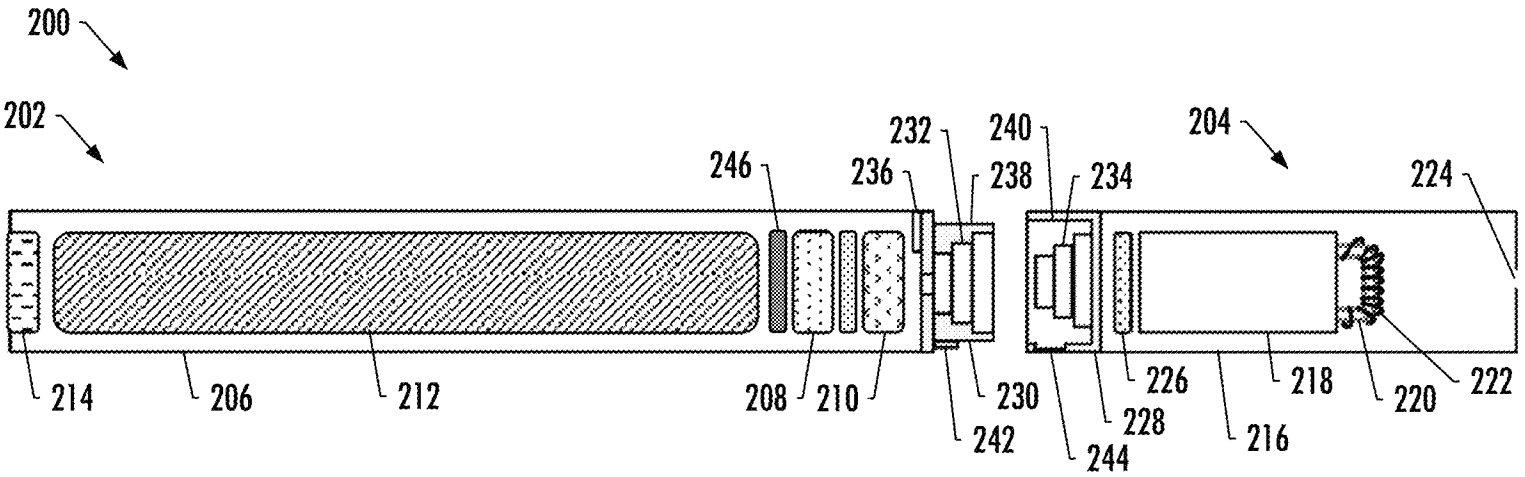
FIG. 2 is a partially cut-away view of an aerosol delivery device that according to various example implementations may correspond to the aerosol delivery device of FIG. 1.

FIG. 2 illustrates a more particular example of a suitable aerosol delivery device 200 that in some examples may correspond to the aerosol delivery device 100 of FIG. 1. As seen in the cut-away view illustrated therein, the aerosol delivery device can comprise a control body 202 and a cartridge 204, which may correspond to respectively the control body 102 and cartridge 104 of FIG. 1. As illustrated in FIG. 2, the control body 202 can be formed of a control body shell 206 that can include a control component 208 (e.g., a microprocessor, individually or as part of a microcontroller), a flow sensor 210, a battery 212 and one or more light-emitting diodes (LEDs) 214, and such components can be variably aligned. Further indicators (e.g., a haptic feedback component, an audio feedback component, or the like) can be included in addition to or as an alternative to the LED. The cartridge 204 can be formed of a cartridge shell 216 enclosing a reservoir 218 that is in fluid communication with a liquid transport element 220 adapted to wick or otherwise transport an aerosol precursor composition stored in the reservoir housing to a heater 222 (sometimes referred to as a heating element). In some example, a valve may be positioned between the reservoir and heater, and configured to control an amount of aerosol precursor composition passed or delivered from the reservoir to the heater.

Various examples of materials configured to produce heat when electrical current is applied therethrough may be employed to form the heater 222. The heater in these examples may be resistive heating element such as a wire coil. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), graphite and graphite-based materials (e.g., carbon-based foams and yarns) and ceramics (e.g., positive or negative temperature coefficient ceramics). Example implementations of heaters or heating members useful in aerosol delivery devices according to the present disclosure are further described below, and can be incorporated into devices such as illustrated in FIG. 2 as described herein.

An opening 224 may be present in the cartridge shell 216 (e.g., at the mouthend) to allow for egress of formed aerosol from the cartridge 204. Such components are representative of the components that may be present in a cartridge and are not intended to limit the scope of cartridge components that are encompassed by the present disclosure.

The cartridge 204 also may include one or more electronic components 226, which may include an integrated circuit, a memory component, a sensor, or the like. The electronic components may be adapted to communicate with the control component 208 and/or with an external device by wired or wireless means. The electronic components may be positioned anywhere within the cartridge or a base 228 thereof.

Although the control component 208 and the flow sensor 210 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some examples, the air flow sensor may comprise its own circuit board or other base element to which it can be attached. In some examples, a flexible circuit board may be utilized. A flexible circuit board may be configured into a variety of shapes, include substantially tubular shapes. In some examples, a flexible circuit board may be combined with, layered onto, or form part or all of a heater substrate as further described below.

The control body 202 and the cartridge 204 may include components adapted to facilitate a fluid engagement therebetween. As illustrated in FIG. 2, the control body can include a coupler 230 having a cavity 232 therein. The base 228 of the cartridge can be adapted to engage the coupler and can include a projection 234 adapted to fit within the cavity. Such engagement can facilitate a stable connection between the control body and the cartridge as well as establish an electrical connection between the battery 212 and control component 208 in the control body and the heater 222 in the cartridge. Further, the control body shell 206 can include an air intake 236, which may be a notch in the shell where it connects to the coupler that allows for passage of ambient air around the coupler and into the shell where it then passes through the cavity 232 of the coupler and into the cartridge through the projection 234.

A coupler and a base useful according to the present disclosure are described in U.S. Pat. App. Pub. No. 2014/0261495 to Novak et al., which is incorporated herein by reference in its entirety. For example, the coupler 230 as seen in FIG. 2 may define an outer periphery 238 configured to mate with an inner periphery 240 of the base 228. In one example the inner periphery of the base may define a radius that is substantially equal to, or slightly greater than, a radius of the outer periphery of the coupler. Further, the coupler may define one or more protrusions 242 at the outer periphery configured to engage one or more recesses 244 defined at the inner periphery of the base. However, various other examples of structures, shapes and components may be employed to couple the base to the coupler. In some examples the connection between the base of the cartridge 204 and the coupler of the control body 202 may be substantially permanent, whereas in other examples the connection therebetween may be releasable such that, for example, the control body may be reused with one or more additional cartridges that may be disposable and/or refillable.

The aerosol delivery device 200 may be substantially rod-like or substantially tubular shaped or substantially cylindrically shaped in some examples. In other examples, further shapes and dimensions are encompassed—e.g., a rectangular or triangular cross-section, multifaceted shapes, or the like.

The reservoir 218 illustrated in FIG. 2 can be a container or can be a fibrous reservoir, as presently described. For example, the reservoir can comprise one or more layers of nonwoven fibers substantially formed into the shape of a tube encircling the interior of the cartridge shell 216, in this example. An aerosol precursor composition can be retained in the reservoir. Liquid components, for example, can be sorptively retained by the reservoir. The reservoir can be in fluid connection with the liquid transport element 220. The liquid transport element can transport the aerosol precursor composition stored in the reservoir via capillary action to the heater 222 that is in the form of a metal wire coil in this example. As such, the heater is in a heating arrangement with the liquid transport element. Example implementations of reservoirs and transport elements useful in aerosol delivery devices according to the present disclosure are further described below, and such reservoirs and/or transport elements can be incorporated into devices such as illustrated in FIG. 2 as described herein. In particular, specific combinations of heating members and transport elements as further described below may be incorporated into devices such as illustrated in FIG. 2 as described herein.

In use, when a user draws on the aerosol delivery device 200, airflow is detected by the flow sensor 210, and the heater 222 is activated to vaporize components of the aerosol precursor composition. Drawing upon the mouthend of the aerosol delivery device causes ambient air to enter the air intake 236 and pass through the cavity 232 in the coupler 230 and the central opening in the projection 234 of the base 228. In the cartridge 204, the drawn air combines with the formed vapor to form an aerosol. The aerosol is whisked, aspirated or otherwise drawn away from the heater and out the opening 224 in the mouthend of the aerosol delivery device.

In some examples, the aerosol delivery device 200 may include a number of additional software-controlled functions. For example, the aerosol delivery device may include a battery protection circuit configured to detect battery input, loads on the battery terminals, and charging input. The battery protection circuit may include short-circuit protection and under-voltage lock out. The aerosol delivery device may also include components for ambient temperature measurement, and its control component 208 may be configured to control at least one functional element to inhibit battery charging if the ambient temperature is below a certain temperature (e.g., 0° C.) or above a certain temperature (e.g., 45° C.) prior to start of charging or during charging.

Power delivery from the battery 212 may vary over the course of each puff on the device 200 according to a power control mechanism. The device may include a "long puff" safety timer such that in the event that a user or an inadvertent mechanism causes the device to attempt to puff continuously, the control component 208 may control at least one functional element to terminate the puff automatically after some period of time (e.g., four seconds). Further, the time between puffs on the device may be restricted to less than a period of time (e.g., 100). A watchdog safety timer may automatically reset the aerosol delivery device if its control component or software running on it becomes unstable and does not service the timer within an appropriate time interval (e.g., eight seconds). Further safety protection may be provided in the event of a defective or otherwise failed flow sensor 210, such as by permanently disabling the aerosol delivery device in order to prevent inadvertent heating. A puffing limit switch may deactivate the device in the event of a pressure sensor fail causing the device to continuously activate without stopping after the four second maximum puff time.

The aerosol delivery device 200 may include a puff tracking algorithm configured for heater lockout once a defined number of puffs has been achieved for an attached cartridge (based on the number of available puffs calculated in light of the e-liquid charge in the cartridge). The aerosol delivery device may include a sleep, standby or low-power mode function whereby power delivery may be automatically cut off after a defined period of non-use. Further safety protection may be provided in that all charge/discharge cycles of the battery 212 may be monitored by the control component 208 over its lifetime. After the battery has attained the equivalent of a predetermined number (e.g., 200) full discharge and full recharge cycles, it may be declared depleted, and the control component may control at least one functional element to prevent further charging of the battery.

The various components of an aerosol delivery device according to the present disclosure can be chosen from components described in the art and commercially available. Examples of batteries that can be used according to the disclosure are described in U.S. Pat. App. Pub. No. 2010/0028766 to Peckerar et al., which is incorporated herein by reference in its entirety.

The aerosol delivery device 200 can incorporate the sensor 210 or another sensor or detector for control of supply of electric power to the heater 222 when aerosol generation is desired (e.g., upon draw during use). As such, for example, there is provided a manner or method of turning off the power supply to the heater when the aerosol delivery device is not be drawn upon during use, and for turning on the power supply to actuate or trigger the generation of heat by the heater during draw. Additional representative types of sensing or detection mechanisms, structure and configuration thereof, components thereof, and general methods of operation thereof, are described in U.S. Pat. No. 5,261,424 to Sprinkel, Jr., U.S. Pat. No. 5,372,148 to McCafferty et al., and PCT Pat. App. Pub. No. WO 2010/003480 to Flick, all of which are incorporated herein by reference in their entireties.

The aerosol delivery device 200 most preferably incorporates the control component 208 or another control mechanism for controlling the amount of electric power to the heater 222 during draw. Representative types of electronic components, structure and configuration thereof, features thereof, and general methods of operation thereof, are described in U.S. Pat. No. 4,735,217 to Gerth et al., U.S. Pat. No. 4,947,874 to Brooks et al., U.S. Pat. No. 5,372,148 to McCafferty et al., U.S. Pat. No. 6,040,560 to Fleischhauer et al., U.S. Pat. No. 7,040,314 to Nguyen et al., U.S. Pat. No. 8,205,622 to Pan, U.S. Pat. App. Pub. No. 2009/0230117 to Fernando et al., U.S. Pat. App. Pub. No. 2014/0060554 to Collet et al., U.S. Pat. App. Pub. No. 2014/0270727 to Ampolini et al., and U.S. patent application Ser. No. 14/209,191 to Henry et al., filed Mar. 13, 2014, all of which are incorporated herein by reference in their entireties.

Representative types of substrates, reservoirs or other components for supporting the aerosol precursor are described in U.S. Pat. No. 8,528,569 to Newton, U.S. Pat. App. Pub. No. 2014/0261487 to Chapman et al., U.S. patent application Ser. No. 14/011,992 to Davis et al., filed Aug. 28, 2013, and U.S. patent application Ser. No. 14/170,838 to Bless et al., filed Feb. 3, 2014, all of which are incorporated herein by reference in their entireties. Additionally, various wicking materials, and the configuration and operation of those wicking materials within certain types of electronic cigarettes, are set forth in U.S. Pat. App. Pub. No. 2014/0209105 to Sears et al., which is incorporated herein by reference in its entirety.

The aerosol precursor composition, also referred to as a vapor precursor composition, may comprise a variety of components including, by way of example, a polyhydric alcohol (e.g., glycerin, propylene glycol or a mixture thereof), nicotine, tobacco, tobacco extract and/or flavorants. Various components that may be included in the aerosol precursor composition are described in U.S. Pat. No. 7,726,320 to Robinson et al., which is incorporated herein by reference in its entirety. Additional representative types of aerosol precursor compositions are set forth in U.S. Pat. No. 4,793,365 to Sensabaugh, Jr. et al., U.S. Pat. No. 5,101,839 to Jakob et al., U.S. Pat. No. 6,779,531 to Biggs et al., U.S. Pat. App. Pub. No. 2013/0008457 to Zheng et al., and Chemical and Biological Studies on New Cigarette Prototypes that Heat Instead of Burn Tobacco, R. J. Reynolds Tobacco Company Monograph (1988), all of which are incorporated herein by reference in their entireties.

Additional representative types of components that yield visual cues or indicators may be employed in the aerosol delivery device 200, such as LEDs and related components, auditory elements (e.g., speakers), vibratory elements (e.g., vibration motors) and the like. Examples of suitable LED components, and the configurations and uses thereof, are described in U.S. Pat. No. 5,154,192 to Sprinkel et al., U.S. Pat. No. 8,499,766 to Newton, U.S. Pat. No. 8,539,959 to Scatterday, and U.S. patent application Ser. No. 14/173,266 to Sears et al., filed Feb. 5, 2014, all of which are incorporated herein by reference in their entireties.

Yet other features, controls or components that can be incorporated into aerosol delivery devices of the present disclosure are described in U.S. Pat. No. 5,967,148 to Harris et al., U.S. Pat. No. 5,934,289 to Watkins et al., U.S. Pat. No. 5,954,979 to Counts et al., U.S. Pat. No. 6,040,560 to Fleischhauer et al., U.S. Pat. No. 8,365,742 to Hon, U.S. Pat. No. 8,402,976 to Fernando et al., U.S. Pat. App. Pub. No. 2005/0016550 to Katase, U.S. Pat. App. Pub. No. 2010/0163063 to Fernando et al., U.S. Pat. App. Pub. No. 2013/0192623 to Tucker et al., U.S. Pat. App. Pub. No. 2013/0298905 to Leven et al., U.S. Pat. App. Pub. No. 2013/0180553 to Kim et al., U.S. Pat. App. Pub. No. 2014/0000638 to Sebastian et al., U.S. Pat. App. Pub. No. 2014/0261495 to Novak et al., and U.S. Pat. App. Pub. No. 2014/0261408 to DePiano et al., all of which are incorporated herein by reference in their entireties.

The control component 208 includes a number of electronic components, and in some examples may be formed of a printed circuit board (PCB) that supports and electrically connects the electronic components. The electronic components may include a microprocessor or processor core, and a memory. In some examples, the control component may include a microcontroller with integrated processor core and memory, and which may further include one or more integrated input/output peripherals.

The aerosol delivery device 200 may further include a communication interface 246 coupled to the control component 208, and which may be configured to enable wireless communication. In some examples, the communication interface may be included on the PCB of the control component, or a separate PCB that may be coupled to the PCB or one or more components of the control component. The communication interface may enable the aerosol delivery device to wirelessly communicate with one or more networks, computing devices or other appropriately-enabled devices. Examples of suitable computing devices include any of a number of different mobile computers. More particular examples of suitable mobile computers include portable computers (e.g., laptops, notebooks, tablet computers), mobile phones (e.g., cell phones, smartphones), wearable computers (e.g., smartwatches) and the like. In other examples, the computing device may be embodied as other than a mobile computer, such as in the manner of a desktop computer, server computer or the like. And in yet another example, the computing device may be embodied as an electric beacon such as one employing iBeacon™ technology developed by Apple Inc. Examples of suitable manners according to which the aerosol delivery device may be configured to wirelessly communicate are disclosed in U.S. patent application Ser. No. 14/327,776, filed Jul. 10, 2014, to Ampolini et al., and U.S. patent application Ser. No.

14/609,032, filed Jan. 29, 2015, to Henry, Jr. et al., each of which is incorporated herein by reference in its entirety.

The communication interface 246 may include, for example, an antenna (or multiple antennas) and supporting hardware and/or software for enabling wireless communication with a communication network (e.g., a cellular network, Wi-Fi, WLAN, and/or the like), and/or for supporting device-to-device, short-range communication, in accordance with a desired communication technology. Examples of suitable short-range communication technologies that may be supported by the communication interface include various near field communication (NFC) technologies, wireless personal area network (WPAN) technologies and the like. More particular examples of suitable WPAN technologies include those specified by IEEE 802.15 standards or otherwise, including Bluetooth, Bluetooth low energy (Bluetooth LE), ZigBee, infrared (e.g., IrDA), radio-frequency identification (RFID), Wireless USB and the like. Yet other examples of suitable short-range communication technologies include Wi-Fi Direct, as well as certain other technologies based on or specified by IEEE 802.11 standards and that support direct device-to-device communication.

Figure 3:
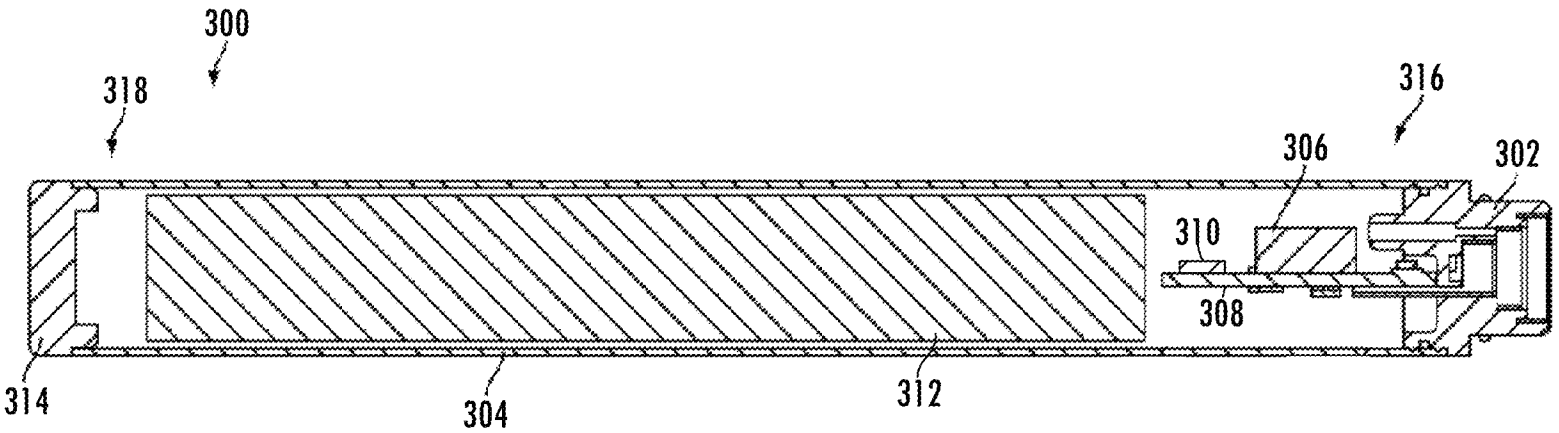
FIGS. 3, 4 and 5 illustrates a longitudinal sectional view through a control body including an outer body and various types of antennas according to example implementations.

FIG. 3 illustrates a cross-sectional view through a control body 300 that in some examples may correspond to the control body 102 illustrated in FIG. 1, and in turn the control body 202 illustrated in FIG. 2. In this regard, the control body may be configured to engage the above-described cartridge 102, 202 and/or various other example implementations of cartridges. Accordingly, the control body 300 may be configured to direct current to the cartridge in substantially the same manner as described above with respect to the control body 102, 202 illustrated in either or both FIG. 1 or 2 to produce an aerosol during use.

As shown, the control body 300 may include a coupler 302, a shell or outer body 304, a flow sensor 306, a control component 308 (e.g., a PCB supporting and electrically connecting electronic components), a communication interface (e.g., on the PCB of the control component) including an antenna 310, an electrical power source 312 (e.g., a battery that may be rechargeable), and an end cap 314. The coupler may be coupled to a first longitudinal end 316 of the outer body, and the end cap may be coupled to an opposing, second longitudinal end 318 of the outer body. Thereby, the flow sensor, control component, communication interface with antenna, and electrical power source may be substantially contained within the outer body and between the end cap and coupler.

As also shown, in some examples, the flow sensor 306 may be coupled to the control component 308, which may receive a signal from the flow sensor (e.g., indicating when a user draw is detected), and direct current to the cartridge 102, 202 (see, e.g., FIGS. 1, 2) to produce an aerosol. Although not separately called out, a pressure channel may be defined through the coupler 302, and may include a first end at which the pressure channel may be in communication with a cavity defined by the coupler. The cavity may be sized and shaped to receive a projection defined by a base of the cartridge. The pressure channel may also include a second end positioned inside the outer body 304. The flow sensor may be thereby in fluid communication with the cartridge through the pressure channel such that the flow sensor may detect a draw on the cartridge. Additional details with regard to the coupler and the general configuration of the control body are provided in U.S. patent application Ser. No. 14/193,961, filed Feb. 28, 2014, to Worm et al., which is incorporated herein by reference in its entirety.

In accordance with example implementations, the antenna 310 may be a monopole antenna, differential antenna or other similarly appropriate antenna. The housing and antenna may be both electrically resonant and tightly coupled, and in this manner, they may form dipole antenna. As shown in FIG. 3, one example of a suitable antenna 310 is a chip antenna mounted to the PCB of the control component 308. The electric field of the electromagnetic radiation generated by the antenna may couple from the antenna to an inside wall of the outer body 304, which may in turn drive the outer body to radiate, and thereby produce a dipole effect.

In some examples, when the control body 300 is coupled with a cartridge 102, the two components may have a combined length—and the aerosol delivery device 100, 200 may have a length—that is approximately a full wavelength within (e.g., at the center of) a desired frequency band for wireless communication. As such, the aerosol delivery device including the control body and cartridge may be resonant in the desired frequency band and with the antenna form an efficient antenna system. In the case of Bluetooth, for example, the combined length (e.g., $\lambda$=4.75 inches) of the control body and cartridge may be approximately a full wavelength at 2.45 GHz.

Figure 4:
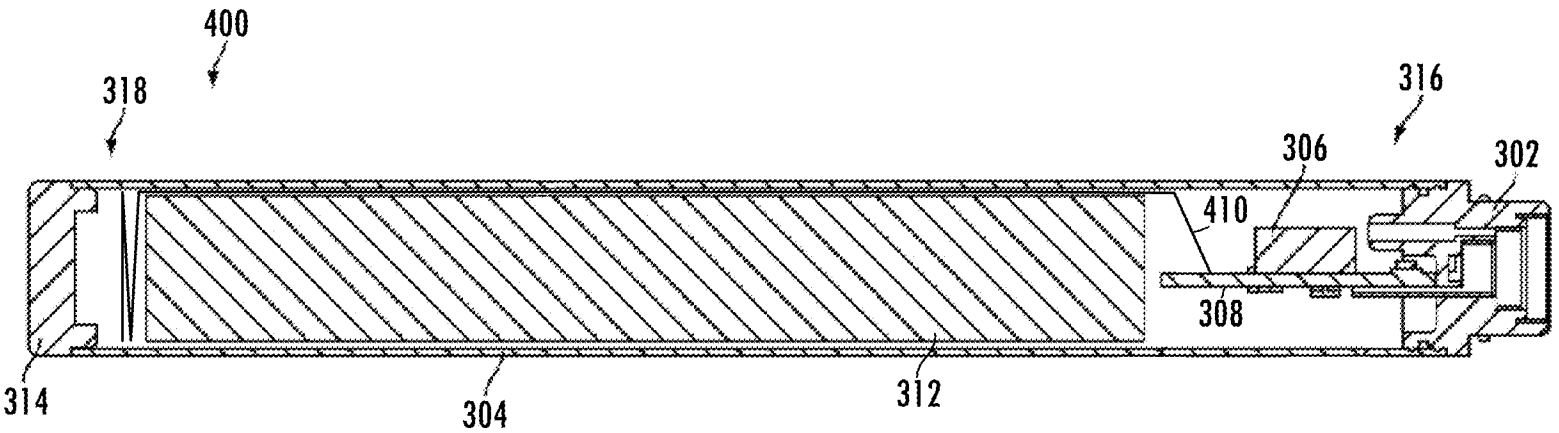

In FIG. 3, the antenna 310 is illustrates as a monopole chip antenna. Other examples of suitable antennas include half-wave or quarter-wave antennas of various structures. FIG. 4 illustrates a control body 400 similar to the control body 300 of FIG. 3, but including a wire antenna 410 (e.g., half-wave monopole antenna) extending along a longitudinal length of the outer body 304, the longitudinal length being between the opposing longitudinal ends 316, 318 of the outer body. In some examples, the wire antenna may be composed of a single wire of a particular length (e.g., 2.4 inches). The wire antenna may be connected to the PCB of the control component 308, and run the longitudinal length of the power source 312 (and may be taped or otherwise affixed to the outside of the electrical power source), with any excess coiled up in front of one or more (e.g., two) LEDs (e.g., LEDs 214, shown in FIG. 2) between the electrical power source and end cap 314. The wire antenna may be connected to the PCB of the control component along with other wires or groups of wires, such as those for the electrical power source, ground and indicator(s). In some examples, the wire antenna may be positioned halfway between the other wires or groups of wires.

Figure 5:
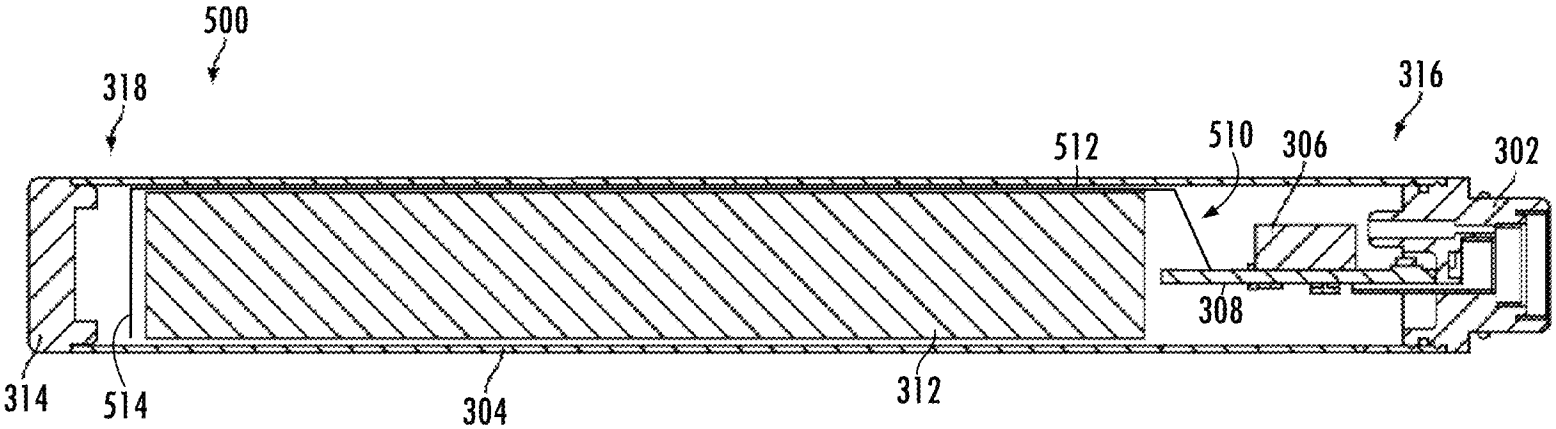
Figure 6:
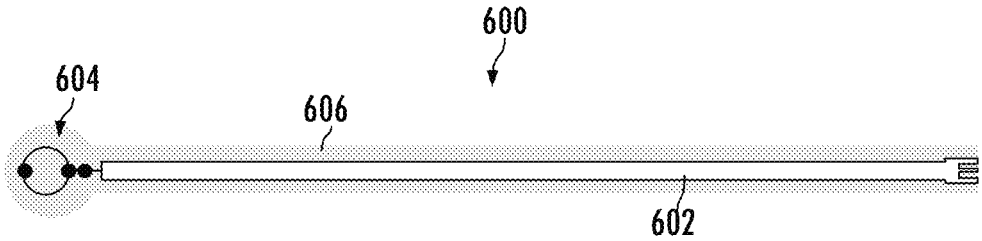
FIGS. 6 and 7 illustrate example flexible circuit antennas suitable for use in an aerosol delivery device according to example implementations.
Figure 7:
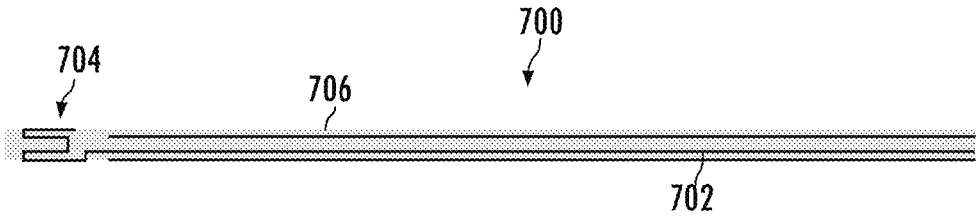

FIG. 5 illustrates another example control body 500 similar to the control body 300 of FIG. 3, but including a flexible circuit antenna 510 (e.g., quarter-wave monopole antenna) extending along the longitudinal length of the outer body. The flexible circuit antenna may include a stripline feed 512 and an antenna element 514 affixed to a substrate. FIG. 6 illustrates one example of a suitable flexible circuit antenna 600 including a stripline feed 602 and an antenna element 604 affixed to a substrate 606. FIG. 7 illustrates another example of a suitable flexible circuit antenna 700 including a stripline feed 702 and an antenna element 704 affixed to a substrate 706. And in yet other examples, the antenna may be a wire (or other) differential antenna.

Returning to FIG. 5, the stripline feed 512 of the flexible circuit antenna 510 may be coupled to the control component 308 and antenna element 514 at opposing longitudinal ends of the stripline feed. In this regard, the stripline feed may be connected to the PCB of the control component 308, and run the longitudinal length of the power source 312 (and may be taped or otherwise affixed to the outside of the electrical power source), with the antenna element positioned between the electrical power source and end cap 314. Similar to the wire antenna of FIG. 4, the stripline feed may be connected to the PCB of the control component along with and perhaps between other wires or groups of wires.

Figure 8A:
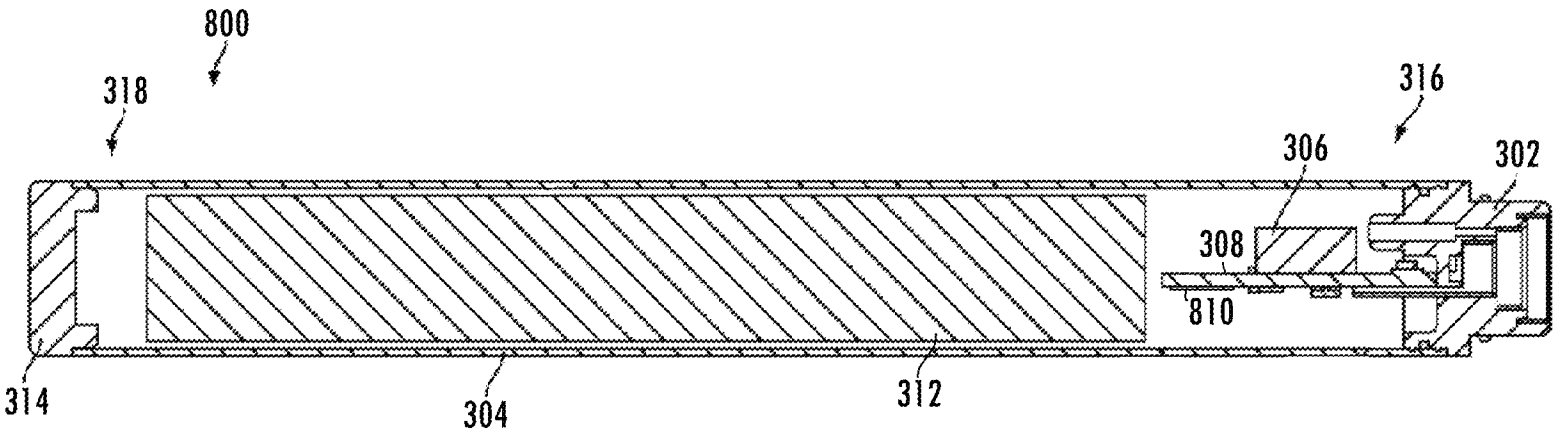
FIGS. 8A and 8B illustrate a longitudinal sectional view through a control body including an outer body and a meander antenna according to example implementations.
Figure 8B:
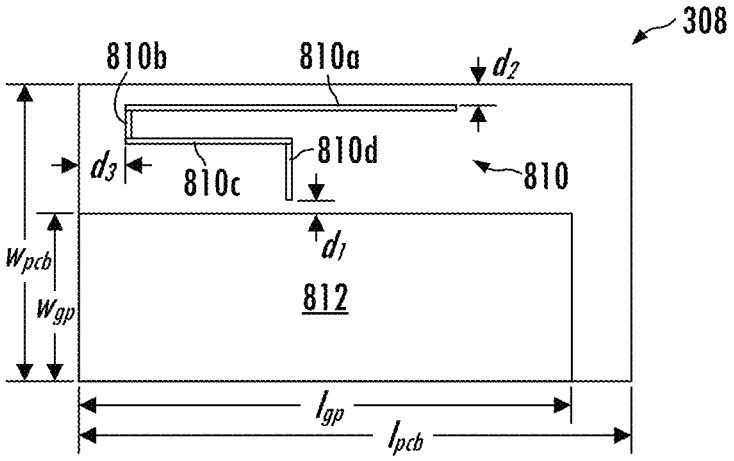

FIG. 8A illustrates yet another example control body 800 similar to the control body 300 of FIG. 3, but including a meander-line antenna 810 that may be implemented as a conductive trace on the PCB of the control component 308, such as on an underside of the PCB proximate a ground plane 812, as shown in FIG. 8B. The meander-line antenna may be composed of a conductive trace folded back and forth to produce a plurality of sections, four example sections 810*a*, 810*b*, 810*c* and 810*d* being shown in FIG. 8B. The number and placement of folds in the conductive trace, and thus the number and lengths of its sections, as well as placement of the antenna on the PCB may be selected in any of a number of different manners to optimize performance of the meander-line antenna.

In one example, the PCB of the control component 308 may have a length $l_{pcb}$ and width $w_{pcb}$ of respectively, approximately 20.86 mm and 13.575 mm. The ground plane 812 may be positioned in alignment with the bottom and one side (e.g., left side) of the underside of the PCB, and have a length $l_{gp}$ and width $w_{gp}$ of respectively, approximately 17.4 mm and 8.95 mm. In this example, the meander-line antenna 810 may be positioned above the ground plane by a distance $d_1$ of approximately 0.5 mm, a distance $d_2$ of approximately 0.7 mm from a top edge of the bottom surface, and a distance $d_3$ of approximately 1.5 mm from the side of the bottom surface with which the ground plane is aligned. And the sections 810*a*, 810*b*, 810*c* and 810*d* of the meander-line antenna may have lengths of respectively, approximately 12 mm, 1.4 mm, 6 mm and 2.025 mm.

Figure 9:
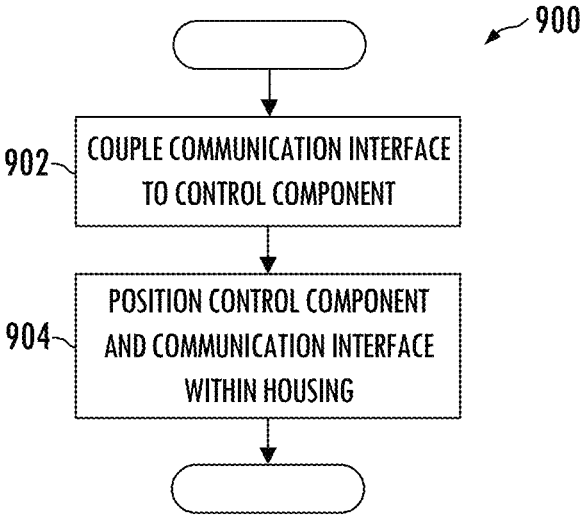
FIG. 9 illustrates various operations in a method of assembling an aerosol delivery device, according to example implementations.

FIG. 9 illustrates various operations in a method 900 of assembling an aerosol delivery device 100, 200. As shown at block 902, the method may include coupling a communication interface to a control component 208, 308. The control component may be configured to control operation of at least one functional element of the aerosol delivery device based on a detected flow of air through at least a portion of a housing (or outer housing) 206, 304. And the communication interface may be configured to enable wireless communication.

As shown at block 904, the method may also include positioning the control component 208, 308 and communication interface within the housing (or outer housing) 206, 304. In some examples, the control component and communication interface may be positioned within the housing that is formed of a metal or alloy, and is substantially tubular in shape. The communication interface may include an antenna 310, 410, 510, 600, 700, 810. In accordance with example implementations, the housing and antenna may both be electrically resonant and tightly coupled in a manner that forms dipole antenna.

In some examples, the method includes assembling a control body including coupling the communication interface to the control component, and positioning the control component and communication interface within the housing, where the control body includes the housing, control component and communication interface. In these examples, the control body may be integral with or coupleable to a cartridge including a heating element. Here, the heating element may be configured to activate and vaporize components of an aerosol precursor composition under control of the control component in response to the flow of air through at least a portion of the housing of the control body, with the air being combinable with a thereby formed vapor to form an aerosol.

In some further examples, when coupled, the control body and cartridge may have a combined length that is approximately a full wavelength within a desired frequency band for wireless communication. And in some further examples, the combined length may be approximately a full wavelength at the center of the desired frequency band.

In some examples, the antenna may a chip antenna, and coupling the communication interface to the control component may include mounting the chip antenna to a printed circuit board of the control component.

In some examples, the antenna may be a half-wave or quarter-wave antenna, and coupling the communication interface to the control component may include coupling the half-wave or quarter-wave antenna to the control component.

In some examples, the antenna may be a wire antenna, and coupling the communication interface to the control component may include coupling the wire antenna to the control component. In these examples, when the control component and communication interface are positioned within the housing, the wire antenna may extend along a longitudinal length of the housing between opposing longitudinal ends thereof.

In some examples, the antenna may be a flexible circuit antenna, and coupling the communication interface to the control component includes coupling the flexible circuit antenna to the control component. In these examples, when the control component and communication interface are positioned within the housing, the flexible circuit antenna may extend along a longitudinal length of the housing between opposing longitudinal ends thereof.

In some further examples, the flexible circuit antenna may include a substrate having a stripline feed and an antenna element affixed thereto. And in these further examples, coupling the communication interface to the control component may include coupling the stripline feed to the control component at a longitudinal end of the stripline feed opposing the antenna element.

The foregoing description of use of the article(s) can be applied to the various example implementations described herein through minor modifications, which can be apparent to the person of skill in the art in light of the further disclosure provided herein. The above description of use, however, is not intended to limit the use of the article but is provided to comply with all necessary requirements of disclosure of the present disclosure. Any of the elements shown in the article(s) illustrated in FIGS. 1-8 or as otherwise described above may be included in an aerosol delivery device according to the present disclosure.

Many modifications and other implementations of the disclosure set forth herein will come to mind to one skilled in the art to which these disclosure pertain having the benefit of the teachings presented in the foregoing descriptions and the associated drawings. Therefore, it is to be understood that the disclosure are not to be limited to the specific implementations disclosed and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An aerosol delivery device comprising:

at least one housing; and contained within the at least one housing, a control component configured to control operation of at least one functional element of the aerosol delivery device based on a detected flow of air through at least a portion of the at least one housing; and a communication interface coupled to the control component and configured to enable wireless communication, the communication interface including an antenna, and the at least one housing and antenna both being electrically resonant and tightly coupled in a manner that forms dipole antenna.

2. The aerosol delivery device of claim 1, wherein the at least one housing is formed of a metal or alloy, and is substantially tubular in shape.

3. The aerosol delivery device of claim 1 comprising a control body including the at least one housing, control component and communication interface, and further comprising:

a cartridge integral with or coupleable to the control body and comprising a heating element configured to activate and vaporize components of an aerosol precursor composition under control of the control component in response to the flow of air through at least a portion of the at least one housing of the control body, the air being combinable with a thereby formed vapor to form an aerosol.

4. The aerosol delivery device of claim 3, wherein when coupled, the control body and cartridge have a combined length that is approximately a full wavelength within a desired frequency band for wireless communication.

5. The aerosol delivery device of claim 4, wherein the combined length is approximately a full wavelength at the center of the desired frequency band.

6. The aerosol delivery device of claim 1, wherein the antenna is a chip antenna mounted to a printed circuit board of the control component.

7. The aerosol delivery device of claim 1, wherein the antenna is a half-wave or quarter-wave antenna.

8. The aerosol delivery device of claim 1, wherein the antenna is a wire antenna extending along a longitudinal length of the at least one housing between opposing longitudinal ends thereof.

9. The aerosol delivery device of claim 1, wherein the antenna is a flexible circuit antenna extending along a longitudinal length of the at least one housing between opposing longitudinal ends thereof.

10. The aerosol delivery device of claim 9, wherein the flexible circuit antenna comprises a substrate having a stripline feed and an antenna element affixed thereto, the stripline feed being coupled to the control component and antenna element at opposing longitudinal ends of thereof.

11. The aerosol delivery device of claim 1, wherein the antenna is a meander-line antenna implemented as a conductive trace on a printed circuit board of the control component.

12. A method for assembling an aerosol delivery device, the method comprising:

coupling a communication interface to a control component, the control component being configured to control operation of at least one functional element of the aerosol delivery device based on a detected flow of air through at least a portion of at least one housing, and the communication interface being configured to enable wireless communication; and positioning the control component and communication interface within the at least one housing, the communication interface including an antenna, and the at least one housing and antenna both being electrically resonant and tightly coupled in a manner that forms dipole antenna.

13. The method of claim 12, wherein positioning the control component and communication interface includes positioning the control component and communication interface within the at least one housing that is formed of a metal or alloy, and is substantially tubular in shape.

14. The method of claim 12 comprising assembling a control body including coupling the communication interface to the control component, and positioning the control component and communication interface within the at least one housing, the control body including the at least one housing, control component and communication interface, wherein the control body is integral with or coupleable to a cartridge comprising a heating element configured to activate and vaporize components of an aerosol precursor composition under control of the control component in response to the flow of air through at least a portion of the at least one housing of the control body, the air being combinable with a thereby formed vapor to form an aerosol.

15. The method of claim 14, wherein when coupled, the control body and cartridge have a combined length that is approximately a full wavelength within a desired frequency band for wireless communication.

16. The method of claim 15, wherein the combined length is approximately a full wavelength at the center of the desired frequency band.

17. The method of claim 12, wherein the antenna is a chip antenna, and coupling the communication interface to the control component includes mounting the chip antenna to a printed circuit board of the control component.

18. The method of claim 12, wherein the antenna is a half-wave or quarter-wave antenna, and coupling the communication interface to the control component includes coupling the half-wave or quarter-wave antenna to the control component.

19. The method of claim 12, wherein the antenna is a wire antenna, and coupling the communication interface to the control component includes coupling the wire antenna to the control component, and wherein when the control component and communication interface are positioned within the at least one housing, the wire antenna extends along a longitudinal length of the at least one housing between opposing longitudinal ends thereof.

20. The method of claim 12, wherein the antenna is a flexible circuit antenna, and coupling the communication interface to the control component includes coupling the flexible circuit antenna to the control component, and wherein when the control component and communication interface are positioned within the at least one housing, the flexible circuit antenna extends along a longitudinal length of the at least one housing between opposing longitudinal ends thereof.

21. The method of claim 20, wherein the flexible circuit antenna comprises a substrate having a stripline feed and an antenna element affixed thereto, and wherein coupling the communication interface to the control component includes coupling the stripline feed to the control component at a longitudinal end of the stripline feed opposing the antenna element.

22. The method of claim 12, wherein the antenna is a meander-line antenna, and coupling the communication interface to the control component includes implementing the meander-line antenna as a conductive trace on a printed circuit board of the control component.

* * * * *